US008875926B2

(12) United States Patent
Grajqevci

(10) Patent No.: US 8,875,926 B2
(45) Date of Patent: Nov. 4, 2014

(54) RESEALABLE MULTI-COMPARTMENT BEVERAGE CONTAINER

(76) Inventor: Valon Grajqevci, San Rafael, CA (US)

( * ) Notice: Subject to any disclaimer, the term of this patent is extended or adjusted under 35 U.S.C. 154(b) by 0 days.

(21) Appl. No.: 13/423,117

(22) Filed: Mar. 16, 2012

(65) Prior Publication Data

US 2013/0240535 A1 Sep. 19, 2013

(51) Int. Cl.

| | |
|---|---|
| ***B65D 17/34*** | (2006.01) |
| ***B65D 43/18*** | (2006.01) |
| ***B65D 51/22*** | (2006.01) |
| ***B65D 47/26*** | (2006.01) |

(52) U.S. Cl.

CPC ..... *B65D 51/22* (2013.01); *B65D 47/265* (2013.01); *Y10S 220/906* (2013.01)

USPC ..... 220/253; 220/500; 220/505; 220/524; 220/906; 220/258.2; 220/810; 220/820; 220/821; 206/219; 206/222; 222/517; 222/557; 222/544

(58) Field of Classification Search

CPC ..... B65D 51/22; B65D 17/34; B65D 47/265; B65D 47/261; B65D 47/36; B65D 2543/0025

USPC ..... 220/253, 505, 524, 906, 711, 254.4, 220/258.2, 820, 821, 719, 716, 730; 206/222; 222/516, 517, 556, 557; 141/103, 104; 413/8; 131/236, 235.1

See application file for complete search history.

(56) References Cited

U.S. PATENT DOCUMENTS

| | | | | | |
|---|---|---|---|---|---|
| 311,415 | A | | 1/1885 | Cleveland | |
| 1,817,562 | A | | 8/1931 | Hodge | |
| 3,045,859 | A | * | 7/1962 | McMahon | 220/521 |
| 3,743,520 | A | * | 7/1973 | Croner | 426/87 |
| 4,077,538 | A | | 3/1978 | Waterbury | |
| 4,585,150 | A | * | 4/1986 | Beacham et al. | 222/129 |
| 4,717,039 | A | * | 1/1988 | Ayyoubi | 220/253 |
| 4,919,295 | A | * | 4/1990 | Hitzler | 220/23.83 |
| 5,285,919 | A | * | 2/1994 | Recchia | 220/271 |
| 5,290,574 | A | * | 3/1994 | Jamieson et al. | 426/112 |
| 5,335,813 | A | | 8/1994 | Qi | |
| 5,492,244 | A | | 2/1996 | Kim | |
| 5,494,184 | A | * | 2/1996 | Noguchi et al. | 220/269 |
| 5,692,633 | A | * | 12/1997 | Gordon | 220/253 |
| 5,695,085 | A | * | 12/1997 | Hadener | 220/269 |
| 5,885,635 | A | * | 3/1999 | Spring et al. | 426/120 |
| 5,992,677 | A | | 11/1999 | Ebine | |
| 6,170,490 | B1 | * | 1/2001 | Barrow | 131/236 |
| 6,263,923 | B1 | * | 7/2001 | Castillo | 141/100 |
| 6,588,617 | B1 | * | 7/2003 | Majcen et al. | 220/254.4 |
| 6,626,314 | B1 | * | 9/2003 | McHenry et al. | 220/254.2 |
| 6,814,081 | B2 | * | 11/2004 | Hasler | 131/235.1 |
| 6,971,551 | B2 | * | 12/2005 | Widgery | 222/129 |
| 7,090,072 | B1 | * | 8/2006 | Elliott | 206/15.3 |
| 7,198,168 | B2 | * | 4/2007 | Mizuma | 220/269 |

(Continued)

*Primary Examiner* — Mickey Yu

*Assistant Examiner* — Gideon Weinerth

(74) *Attorney, Agent, or Firm* — Edward S. Wright

(57) ABSTRACT

Container for beverages, liquids and other fluid substances which includes a plurality of sealed chambers, sealed openings in coplanar walls of the chambers, a stationary cover plate with openings in registration with the sealed openings, an opener movably mounted on the cover plate for selective engagement with seals for the openings in the walls, and a selector plate operatively connected to the opener with an opening in the selector plate that can be moved into and out of registration with the openings in the chamber walls and cover plate.

15 Claims, 2 Drawing Sheets

(56) References Cited

U.S. PATENT DOCUMENTS

| | | | | |
|---|---|---|---|---|
| 7,975,868 | B1 * | 7/2011 | Flies et al. | 220/524 |
| 2001/0019058 | A1 * | 9/2001 | Song | 220/258 |
| 2002/0117499 | A1 * | 8/2002 | Hur | 220/254.4 |
| 2003/0189046 | A1 | 10/2003 | Quispe Gonzalez | |
| 2005/0051553 | A1 * | 3/2005 | Li et al. | 220/254.4 |
| 2005/0077316 | A1 | 4/2005 | Roberts | |
| 2006/0065660 | A1 | 3/2006 | Kalaouze | |
| 2007/0131690 | A1 * | 6/2007 | Gavino Nadal | 220/254.4 |
| 2007/0138178 | A1 * | 6/2007 | Erickson | 220/254.4 |
| 2007/0145055 | A1 * | 6/2007 | Gardiner | 220/254.4 |
| 2007/0221676 | A1 * | 9/2007 | De Godoy | 220/716 |
| 2007/0241114 | A1 | 10/2007 | Roberts | |
| 2008/0054002 | A1 | 3/2008 | Moran | |
| 2009/0272747 | A1 | 11/2009 | Kalaouze, Jr. | |
| 2012/0037669 | A1 * | 2/2012 | Goetz et al. | 222/456 |
| 2012/0199586 | A1 * | 8/2012 | Shamalta | 220/269 |
| 2012/0285962 | A1 * | 11/2012 | Seo | 220/258.2 |
| 2013/0126528 | A1 * | 5/2013 | Jeon | 220/269 |
| 2013/0134065 | A1 * | 5/2013 | Schorre | 206/459.5 |
| 2014/0096491 | A1 * | 4/2014 | Chasteen et al. | 53/492 |

* cited by examiner

Fig. 2
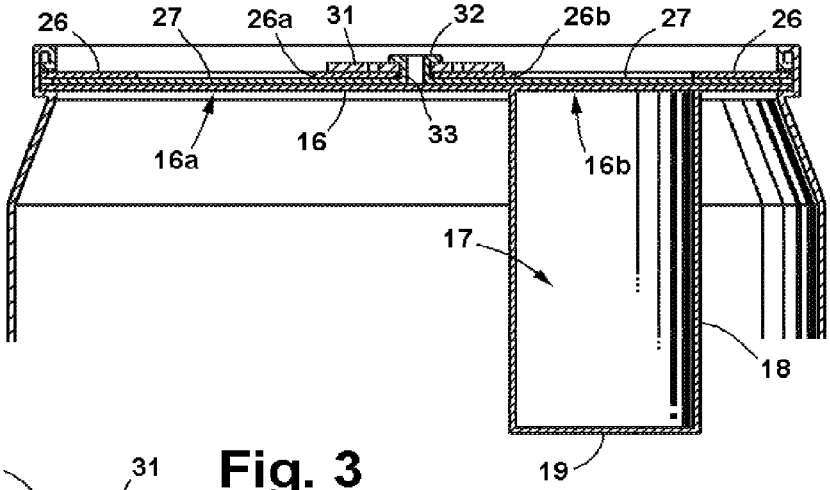
Fig. 3
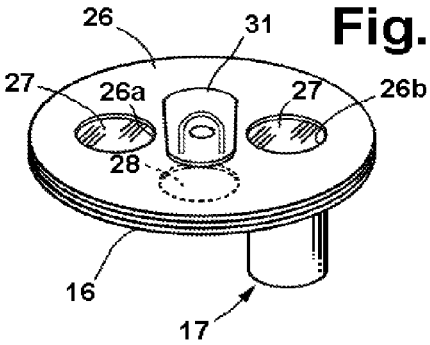
Fig. 4
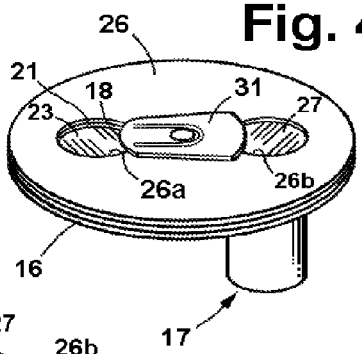
Fig. 5
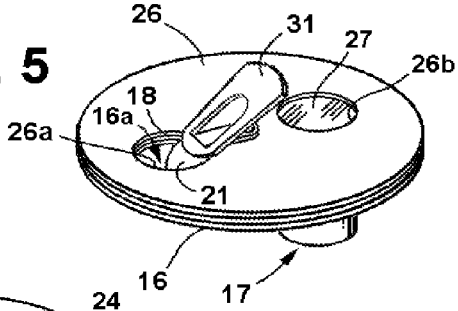
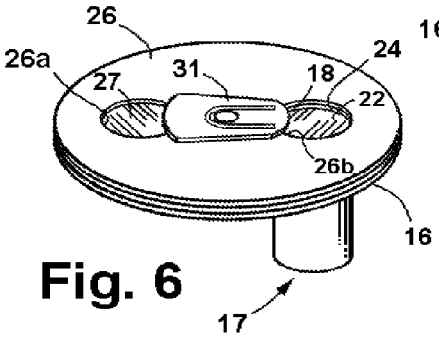
Fig. 6
Fig. 7
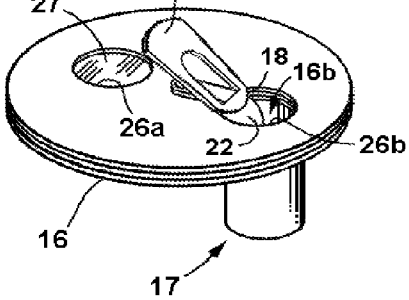

RESEALABLE MULTI-COMPARTMENT BEVERAGE CONTAINER

BACKGROUND OF THE INVENTION

1. Field of Invention

This invention pertains generally to containers for beverages and other fluid substances and, more particularly, to a container having a plurality of resealable chambers for holding different beverages, liquids, or other fluids.

2. Related Art

Where two or more products that are to be mixed together must be kept apart until they are mixed, there have been some attempts to package the different products in a single container having a separate chamber or compartment for each product, rather than packaging the different products in separate containers. Products that might advantageously be packaged in that manner include different types of beverages such as alcoholic beverages and mixers, e.g. scotch and soda, gin and tonic water, vodka and fruit juices, as well as non-alcoholic beverages. Such packaging is not only convenient for the consumer, but also ensures that the products will be combined in the correct proportions.

Examples of beverage cans and other containers having separate chambers for holding different products are found in U.S. Pat. Nos. 311,415, 1,817,562, 4,077,538, 5,335,813, 5,492,244, and 5,992,677 and in Published U.S. Applications Nos. 2003/0189046, 2005/0077316, 2006/0065660, 2007/0241114, 2008/0054002, and 2009/0272747. These containers generally do not include means for resealing the chambers once they have been opened.

OBJECTS AND SUMMARY OF THE INVENTION

It is, in general, an object of the invention to provide a new and improved container having a plurality of chambers for holding different beverages, liquids, or other fluids.

Another object of the invention is to provide a container of the above character which overcomes the limitations and disadvantages of containers heretofore provided.

These and other objects are achieved in accordance with the invention by providing a container for beverages, liquids and other fluid substances which includes a plurality of sealed chambers, sealed openings in coplanar walls of the chambers, a stationary cover plate with openings in registration with the sealed openings, an opener movably mounted on the cover plate for selective engagement with seals for the openings in the walls, and a selector plate operatively connected to the opener with an opening in the selector plate that can be moved into and out of registration with the openings in the chamber walls and cover plate.

BRIEF DESCRIPTION OF THE DRAWINGS

FIG. 2 is an enlarged, fragmentary, sectional view of the embodiment of FIG. 1.

FIGS. 3-7 are operational views of the embodiment of FIG. 1.

DETAILED DESCRIPTION

Figure 1:
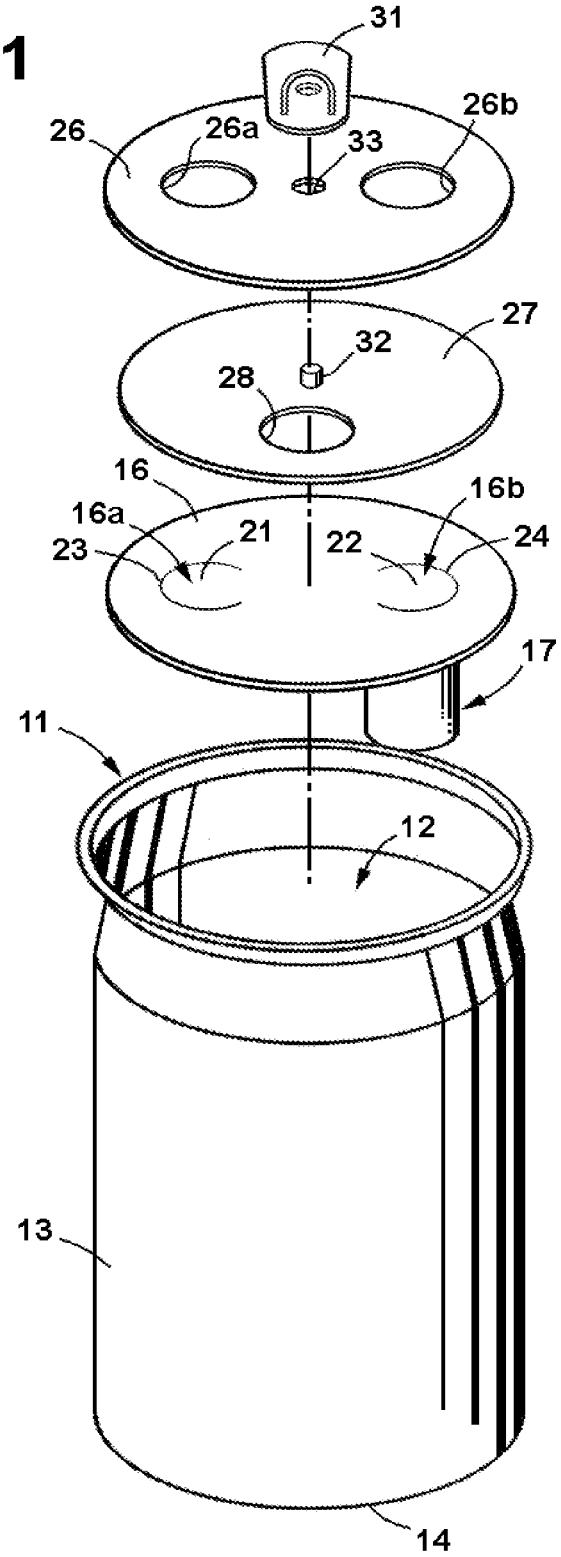
FIG. 1 is an exploded isometric view of one embodiment of a beverage container in accordance with the invention.

In the drawings, the invention is illustrated in connection with a beverage container in the form of a drink can 11 of the type commonly used for packaging beverages such as soft drinks, energy drinks, and beer. The can is typically fabricated of aluminum and has an internal chamber or compartment 12 bounded by a cylindrical side wall 13, a circular bottom wall 14, and a circular top wall 16.

A second chamber or compartment 17 is formed within the can on the under side of top wall 16. The second compartment has a cylindrical side wall 18 and a circular bottom wall 19 of lesser diameter than corresponding walls of the larger compartment. The two compartments are sealed from each other, and in the embodiment illustrated, chamber walls 18, 19 are formed integrally with top wall 16. The relative sizes of the two chambers are determined by the beverages to be stored therein. For a mixed drink in a 12 ounce can, for example, the small compartment might have a volume corresponding to that of a shot glass, which is typically about 1.5 fluid ounces.

Access to the two compartments is provided by sealed openings 16*a*, 16*b* in top wall 16. These openings have displaceable tongues or flaps 21, 22 defined by score lines 23, 24 along which the top wall will separate or rupture when engaged by an opener.

An outer top wall or cover plate 26 is positioned above top wall 16, with openings 26*a*, 26*b* in registration with corresponding ones of the sealed openings 16*a*, 16*b* in the inner top wall. The two top walls are affixed peripherally and sealed to the upper portion of the side wall 13 of the can by crimping or by other suitable means.

A valve member or disk 27 is rotatably mounted between the two top walls or plates in sealing engagement with the upper side of the inner top wall. The valve member has an opening 28 that can be moved into and out of registration with the openings 16*a*, 26*a* and 16*b*, 26*b* in the top walls. The valve member is of slightly lesser diameter than the top walls and is maintained in sealing engagement with them by the forces exerted on the top walls by the manner in which they are clamped together at their peripheries.

A pull-tab 31 is mounted on the upper side of outer top wall 26 for breaking the seals on openings 26, 26*b* to provide access to the beverages in the two compartments. The pull-tab is operatively connected to valve member 27 for rotating the valve member to bring the opening in it into and out of alignment with the openings in the top walls. In the embodiment illustrated, the pull-tab is affixed to the valve member by a rivet 32 which is formed integrally with the valve member and passes freely through a central mounting hole 33 of slightly greater diameter in the outer top wall. The pull-tab is positioned directly above the opening in the valve member and accesses the sealed openings in the inner top wall through the openings in the outer top wall and the valve member. Thus, the pull-tab functions both as an opener for the two compartments and as a handle for the valve member.

Operation and use of the container is illustrated in FIGS. 3-7. In the closed position shown in FIG. 3, pull-tab 31 is pointed away from openings 16*a*, 16*b*, and valve opening 28 is out of registration with the openings in the two top walls. This is the position in which the filled container is shipped and stored, both before and after one or both of the compartments have been opened.

To open the main compartment, pull-tab 31 is rotated into alignment with opening 26*a*, as shown in FIG. 4, thereby bringing valve opening 28 into registration with opening 26*a* and sealed opening 16*a* above the main compartment. With the pull-tab so positioned, pulling up on the outer end portion swings the inner end of the tab through opening 26*a* and valve opening 28 into engagement with sealing flap 21, rupturing the inner top wall along score line 23 and pivoting the flap down to unseal the opening, as illustrated in FIG. 5. If the smaller, shot compartment has already been opened, the valve member will seal opening 16*b* to retain any remaining contents in that compartment while the main compartment is open.

The shot compartment 17 is opened by aligning pull-tab 31 with opening 26*b*, as shown in FIG. 6, thereby bringing valve opening 28 into registration with opening 26*b* and sealed opening 16*b* above the main compartment. Pulling up on the outer end portion now swings the inner end of the tab through opening 26*b* and valve opening 28 into engagement with sealing flap 22, rupturing the inner top wall along score line 24 and pivoting the flap down to unseal the opening, as illustrated in FIG. 7. If the main compartment has already been opened, the valve member will seal opening 16*a* to retain any remaining contents in that compartment while the main compartment is open.

When one or both of the compartments have been opened, the pull-tab and valve member can be returned to the closed position shown in FIG. 3 to reseal the compartments and prevent leakage between them.

The invention has a number of important features and advantages. It provides a container with a plurality of separate, sealed compartments for different beverages and other fluid products with means for selectively opening and resealing the different compartments. Although the invention has been illustrated in connection with a beverage can having two separate compartments, the container can have more compartments, if desired.

Packaging two or more products that are to be mixed together in a single container with separate compartments is not only more convenient than having everything packaged separately. It also ensures that the products will be combined in the correct proportions and is good for the environment in reducing the number of containers that have to be disposed of.

It is apparent from the foregoing that a new and improved container with separate chambers has been provided. While only certain presently preferred embodiments have been described in detail, as will be apparent to those familiar with the art, certain changes and modifications can be made without departing from the scope of the invention as defined by the following claims.

The invention claimed is:

1. A beverage container comprising a plurality of sealed chambers having a top wall, sealed openings in the top wall above the chambers, an outer wall mounted in a fixed position above the top wall, openings in the outer wall aligned with the openings in the top wall, a rotatable disk in sealing engagement with the top wall, an opening in the disk that can be selectively brought into and out of alignment with the openings in the walls, an opener rotatably mounted on the outer wall for selective alignment with the openings above the chambers, and a connector which passes freely through the outer wall and is affixed to the opener and to the disk such that the disk rotates with the opener and the opening in the disk is aligned with the openings with which the opener is aligned.

2. The container of claim 1 wherein the rotatable disk is positioned between the walls.

3. The container of claim 2 wherein the walls are of greater diameter than the disk and are joined together peripherally of the disk.

4. The container of claim 1 wherein the connector comprises a rivet which is formed integrally with the disk.

5. The container of claim 1 wherein the sealed openings are bounded by score lines along which the top wall will separate when engaged by the opener.

6. The container of claim 1 wherein a first chamber has a cylindrical side wall of substantially the same diameter as the top wall, and a second chamber has a cylindrical side wall of lesser diameter than the first chamber.

7. A beverage can comprising a first sealed chamber having cylindrical side wall, a top wall, and a bottom wall, a second sealed chamber formed within the first sealed chamber adjacent to the top wall, first and second sealed openings in the top wall above respective ones of the chambers, an outer wall which is affixed peripherally to the top wall and has openings in registration with the openings in the top wall, a rotatable disk positioned between the top wall and the outer wall with an opening in the disk that can be moved into and out of registration with the openings in the walls, an opener which is rotatably mounted on the outer wall for selective alignment with the openings in the top wall and the outer wall, and a connector which is affixed to the opener, passes freely through the outer wall, and is connected to the disk such that the disk rotates with the opener and the opening in the disk is brought into registration with the openings in the walls with which the opener is aligned.

8. The beverage can of claim 7 wherein the rotatable disk is in sealing engagement with the upper side of the top wall and prevents contents from leaking between the chambers after the sealed openings have been opened.

9. The beverage can of claim 7 wherein the sealed openings are bounded by score lines along which the top wall will separate when engaged by the opener through the openings in the outer wall and the disk.

10. The beverage can of claim 7 wherein the connector is a rivet.

11. A container for beverages, liquids and other fluid substances, comprising a plurality of sealed chambers, sealed openings in coplanar walls of the chambers, a stationary cover plate with openings in registration with the sealed openings, an opener movably mounted on an outer side of the cover plate for selective engagement with seals for the openings in the walls, a selector plate positioned between the cover plate and the walls, and a connector which is affixed to the opener, passes through the cover plate, and is affixed to the selector plate such that the selector plate moves with the opener and an opening in the selector plate can be moved into and out of registration with the openings in the chamber walls and cover plate.

12. The container of claim 11 wherein the selector plate is in sealing engagement with the coplanar walls around the sealed openings.

13. The container of claim 11 wherein the opener and the selector plate are rotatable about an axis disposed centrally of the openings.

14. The container of claim 11 wherein the chambers have cylindrical side walls of different diameter and coplanar top walls in which the sealed openings are formed.

15. The container of claim 14 wherein one chamber is formed within and disposed eccentrically of the other chamber.

* * * * *